US007866772B1

(12) United States Patent
Chen

(10) Patent No.: US 7,866,772 B1
(45) Date of Patent: Jan. 11, 2011

(54) SLIDING RAIL COUPLING STRUCTURE FOR HIDDEN SLIDING TRACK ASSEMBLY

(75) Inventor: Yung-Liang Chen, Taipei Hsien (TW)

(73) Assignee: GSlide Corporation (TW)

( * ) Notice: Subject to any disclaimer, the term of this patent is extended or adjusted under 35 U.S.C. 154(b) by 64 days.

(21) Appl. No.: 12/010,409

(22) Filed: Jan. 24, 2008

(51) Int. Cl.
*A47B 88/00* (2006.01)

(52) U.S. Cl. ..... 312/334.9; 312/334.13; 312/334.16; 312/334.37

(58) Field of Classification Search ... 312/334.6–334.9, 312/334.13–334.21, 334.25–334.26, 334.32–334.33, 312/334.36–334.37, 334.1; 384/18–19
See application file for complete search history.

(56) References Cited

U.S. PATENT DOCUMENTS 4,929,097 A * 5/1990 Mottate ..... 384/49
5,417,489 A * 5/1995 Compagnucci ..... 312/334.11
5,769,518 A * 6/1998 Grabher ..... 312/334.6
5,882,100 A * 3/1999 Rock ..... 312/334.34
6,945,620 B2 * 9/2005 Lam et al. ..... 312/334.6
7,320,508 B2 * 1/2008 Booker et al. ..... 312/334.6
7,465,001 B2 * 12/2008 Lam et al. ..... 312/334.15
7,748,801 B2 * 7/2010 Prenter ..... 312/334.16
7,762,637 B2 * 7/2010 Lam et al. ..... 312/334.6
2003/0091770 A1 * 5/2003 Li et al. ..... 428/35.7
2003/0222556 A1 * 12/2003 Larsen, Jr. ..... 312/334.6
2005/0231083 A1 * 10/2005 Garcie, Jr. ..... 312/333
2009/0238503 A1 * 9/2009 Liang et al. ..... 384/18

FOREIGN PATENT DOCUMENTS

DE 3329541 * 3/1985 ..... 312/334.33

* cited by examiner

*Primary Examiner*—Hanh V Tran
(74) *Attorney, Agent, or Firm*—Cook Alex Ltd.

(57) ABSTRACT

A sliding rail coupling structure includes an outer rail, an intermediate sliding rail slidable in and out of the outer rail and having two longitudinal sliding grooves at two sides, sliding bearing bushes coupled to and movable along the intermediate sliding rail, each sliding bearing bush holding a plurality of roller cylinders that are kept in contact between the top wall of the intermediate sliding rail and the top wall of the outer sliding rail and a plurality of rolling balls that are respectively kept in contact between the longitudinal sliding grooves of the intermediate sliding rail and the sidewalls of the outer sliding rail, a roller holder affixed to the intermediate sliding rail to support two support rollers that are respectively in contact with two bottom flanges of the outer sliding rail.

3 Claims, 8 Drawing Sheets

SLIDING RAIL COUPLING STRUCTURE FOR HIDDEN SLIDING TRACK ASSEMBLY

BACKGROUND AND SUMMARY OF THE INVENTION

The present invention relates to a hidden sliding track assembly for drawer or the like and more particularly, to a sliding rail coupling structure for hidden sliding track assembly, which supports and stabilizes relative sliding movement between the outer sliding rail and the intermediate sliding rail, and has a high structural strength to support a heavy load.

US2005/0231083A1 teaches the use of two sliding bearing bushes between an intermediate sliding rail and an outer sliding rail and two support rollers in the intermediate sliding rail to support and guide movement of the intermediate sliding rail relative to the outer sliding rail. As illustrated in FIG. 1, two sliding bearing bushes 91 and 92 are provided at the top side of the Intermediate sliding rail 90, and two support rollers 93 and 94 are respectively pivotally provided at the two opposite lateral sides of the intermediate sliding rail 90. This design still has drawbacks as follows 1. The rolling cylinders 95 that are mounted in the two opposite sidewalls of the sliding bearing bushes 91 and 92 are respectively disposed in direct contact with the two opposite sidewalls 901 and 902 of the intermediate sliding rail 90 without any guide means. Therefore, the sliding movement of the intermediate sliding rail 90 relative to the outer sliding rail (not shown) is less stable.

2. The fabrication of the intermediate sliding rail 90 is complicated. During fabrication, the prepared metal sheet material is rolled into shape by means of a roll forming mill (see FIG. 2), and then the left and right sidewalls 901 and 902 of the rail are punched to provide a respective through hole 903 and 904 (see FIG. 3), and then the two through holes 903 and 904 are processed to provide a respective pivot axle 9031 and 9041 (see FIG. 4) for supporting the aforesaid support rollers 93 and 94 (see FIG. 1). This fabrication procedure is complicated, wasting much labor and time.

3. The structural strength of the intermediate sliding rail 90 is not sufficient to support a heavy load.

The present invention has been accomplished under the circumstances in view. It is one object of the present invention to provide a sliding rail coupling structure for hidden sliding track assembly, which supports and stabilizes relative sliding movement between the outer sliding rail and the intermediate sliding rail. It is another object of the present invention to provide a sliding rail coupling structure for hidden sliding track assembly, which has a high structural strength to support a heavy load. It is still another aspect of the present invention to provide a sliding rail coupling structure for hidden sliding track assembly, which saves much manufacturing labor and time.

According to one aspect of the present invention, the sliding rail coupling structure comprises an outer rail, an intermediate sliding rail slidable in and out of the outer rail and having two longitudinal sliding grooves at two sides, sliding bearing bushes coupled to and movable along the intermediate sliding rail, each sliding bearing bush holding a plurality of roller cylinders that are kept in contact between the top wall of the intermediate sliding rail and the top wall of the outer sliding rail and a plurality of rolling balls that are respectively kept in contact between the longitudinal sliding grooves of the intermediate sliding rail and the sidewalls of the outer sliding rail, a roller holder affixed to the intermediate sliding rail to support two support rollers that are respectively in contact with two bottom flanges of the outer sliding rail. The longitudinal sliding grooves of the intermediate sliding rail guide and stabilize movement of the rolling balls.

According to another aspect of the present invention, the intermediate sliding rail has two longitudinal reinforcing grooves respectively formed on the two sidewalls to reinforce the structural strength.

According to still another aspect of the present invention, the roller holder can be made of a metal material by means of a stamping technique, facilitating the fabrication of the roller holder and the mounting of the support rollers and saving much the device cost.

DETAILED DESCRIPTION OF THE INVENTION

Figure 1:
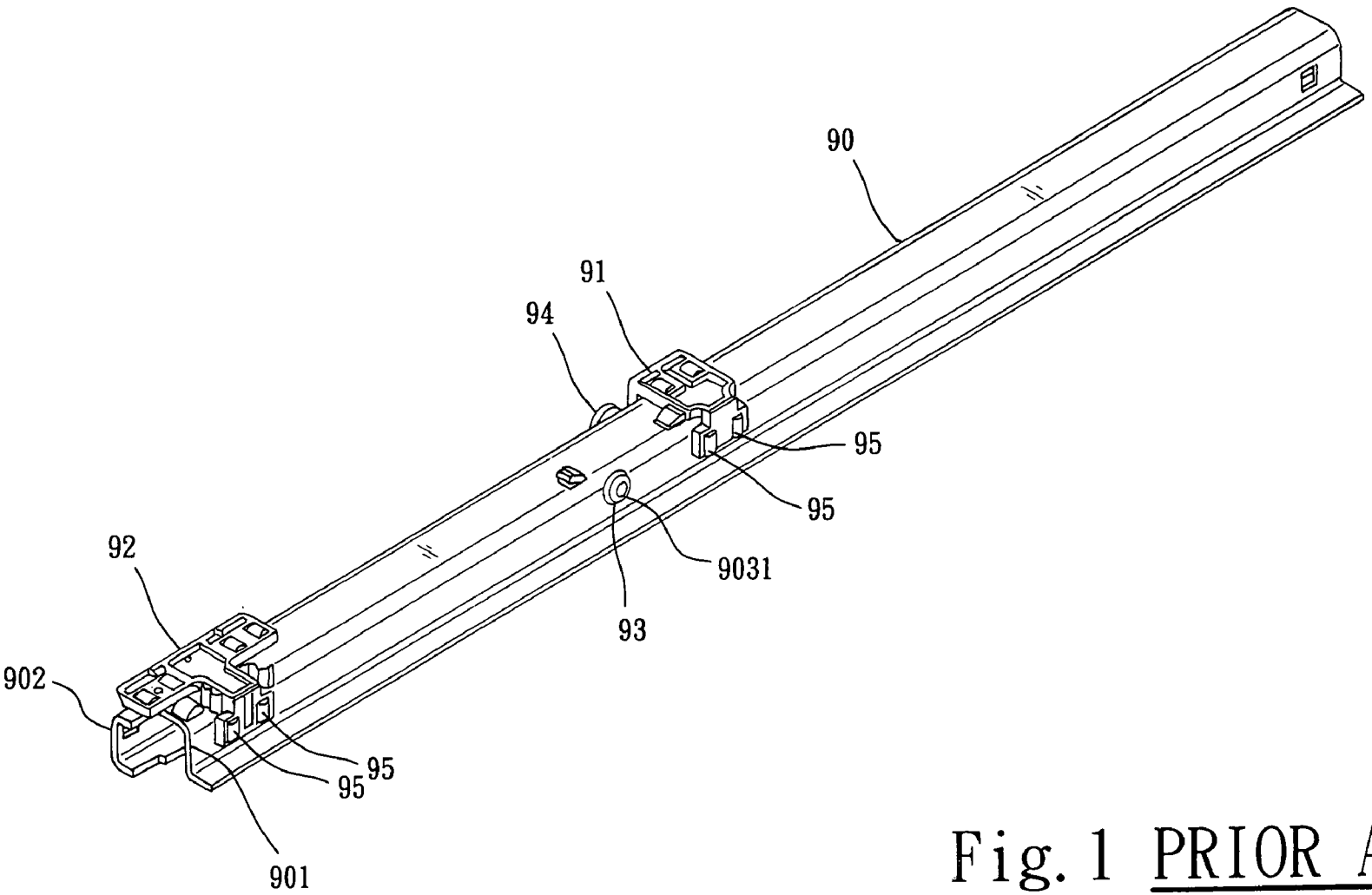
Fig. 1 PRIOR ART
FIG. 1 is an oblique elevation showing two sliding bearing bushes and two support rollers provided at an intermediate sliding rail for sliding track assembly according to the prior art.
Figure 4:
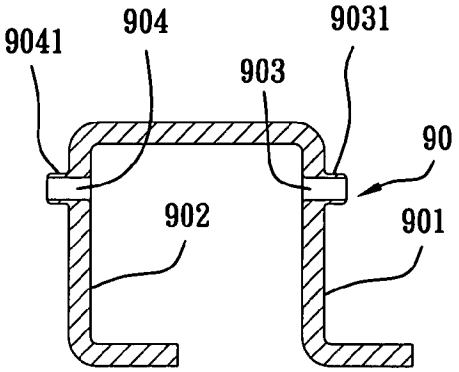
Fig. 4 PRIOR ART
FIG. 4 corresponds to FIG. 3, showing two pivot axles respectively fastened to the through holes on the two opposite sidewalls of the intermediate sliding rail.
Figure 3:
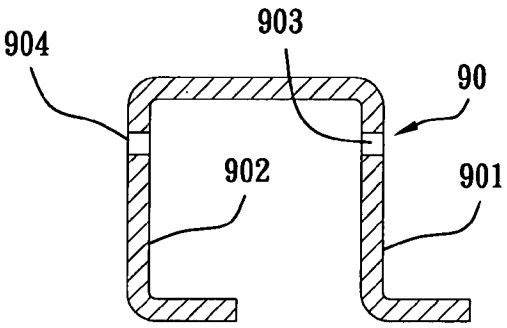
Fig. 3 PRIOR ART
FIG. 3 corresponds to FIG. 2, showing two through holes respectively formed on the two opposite sidewalls of the intermediate sliding rail.
Figure 2:
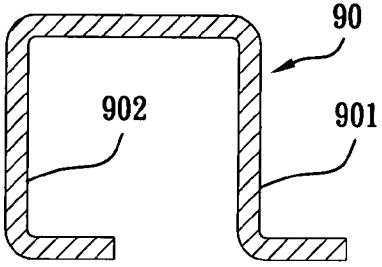
Fig. 2 PRIOR ART
FIG. 2 is a cross sectional view of the intermediate sliding rail according to the prior art.
Figure 5:
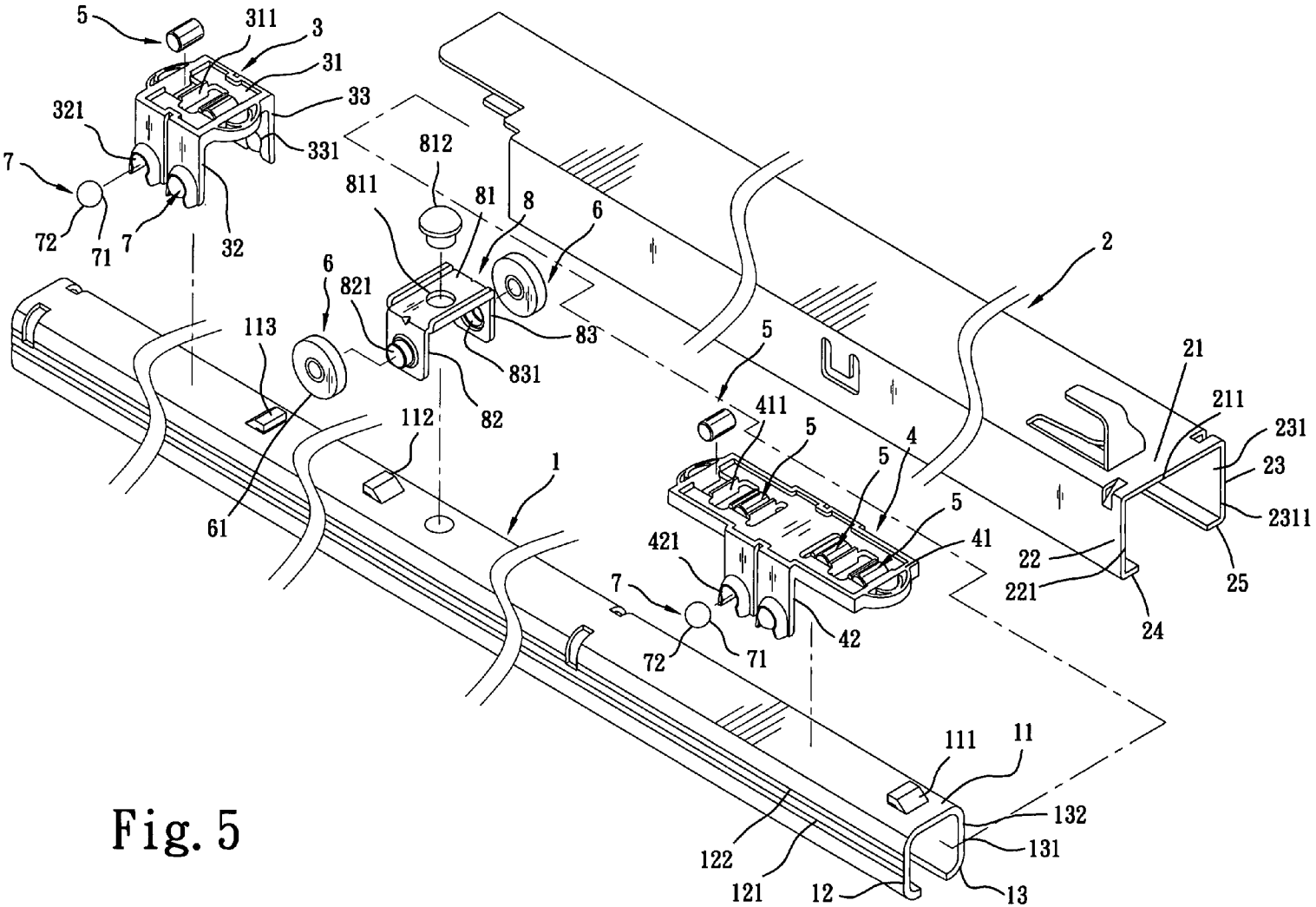
FIG. 5 is an exploded view a sliding rail coupling structure for sliding track assembly according to the present invention.
Figure 6:
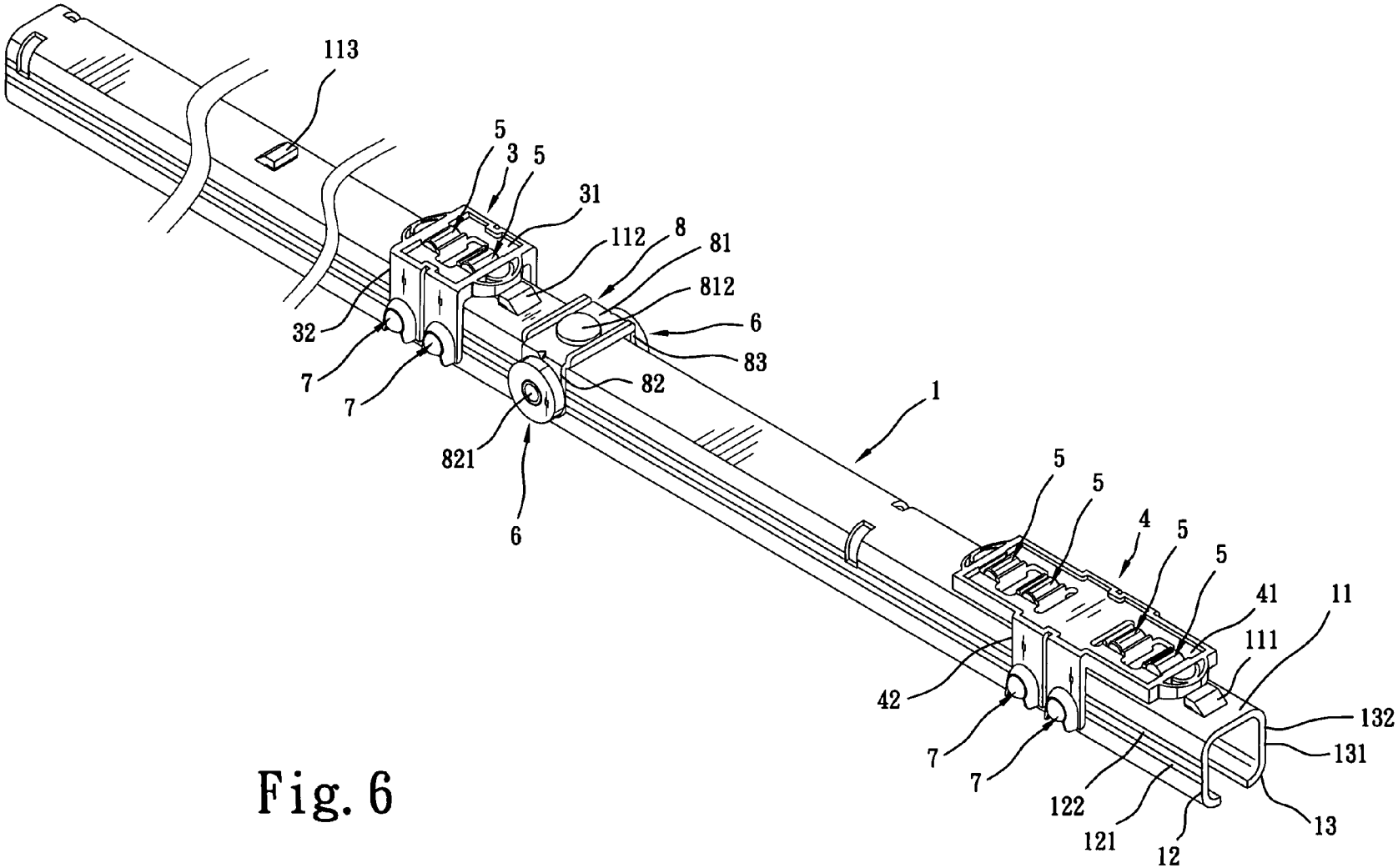
FIG. 6 is an elevational assembly view of a part of the present invention, showing two sliding bearing bushes and a roller holder mounted on the intermediate sliding rail.
Figure 7:
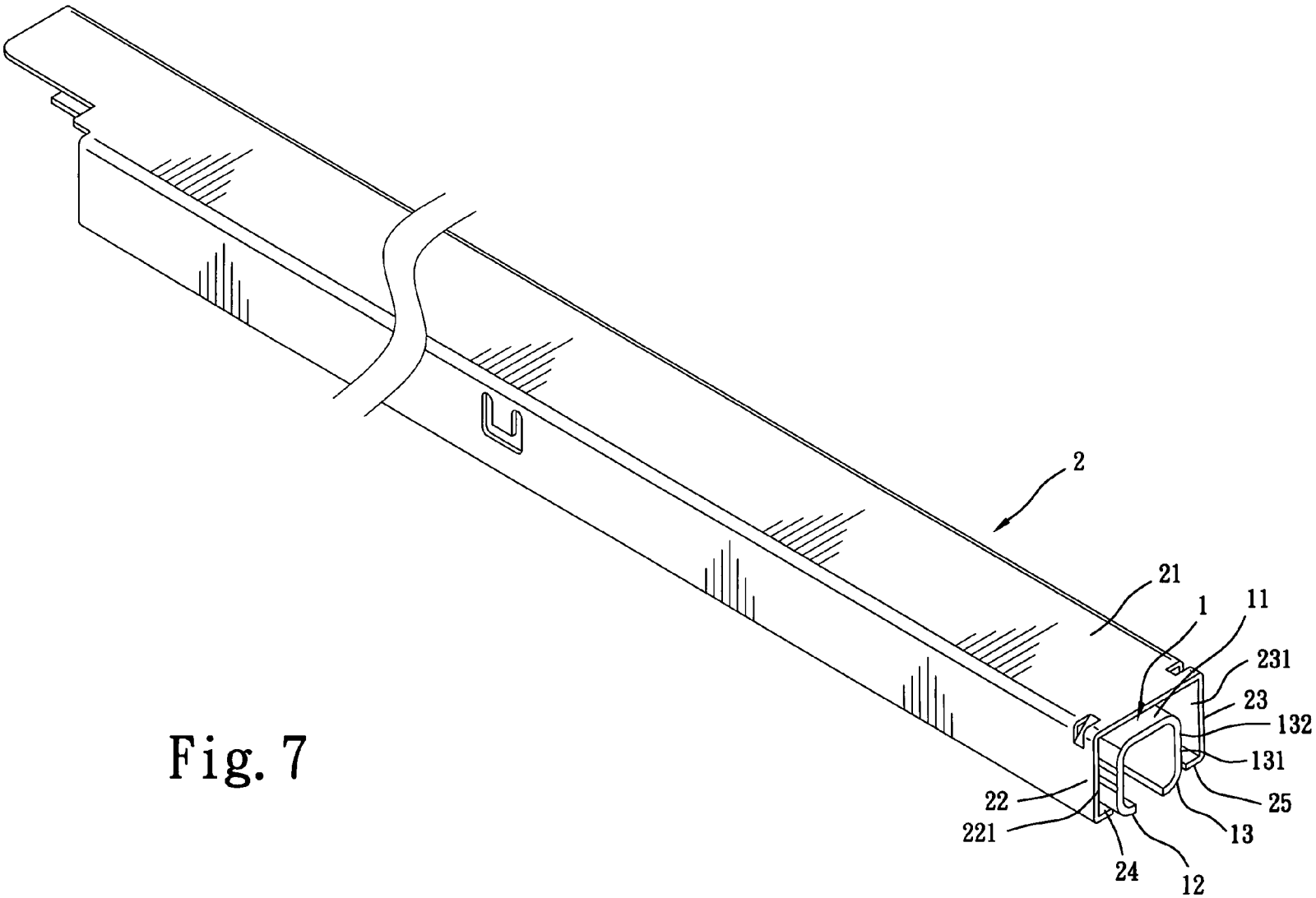
FIG. 7 is an elevational assembly view of the sliding rail coupling structure according to the present invention.
Figure 8:
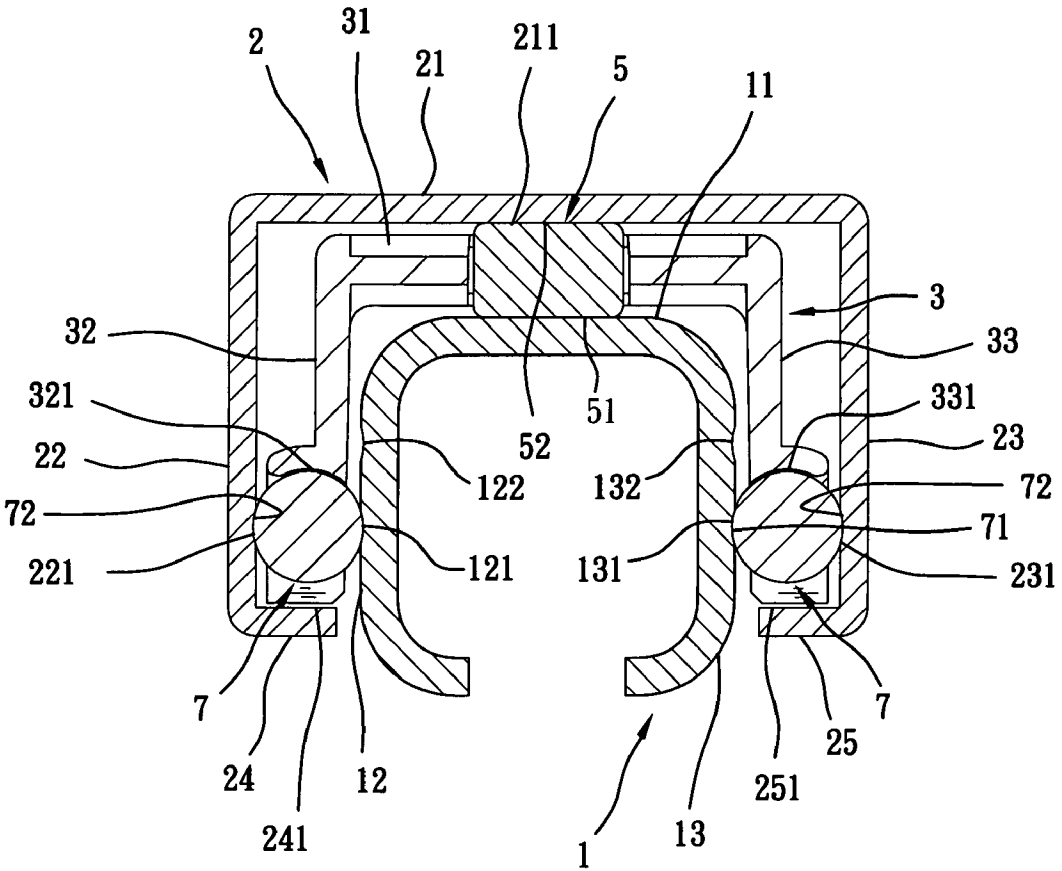
FIG. 8 is a cross-sectional view of the sliding rail coupling structure according to the present invention.
Figure 9:
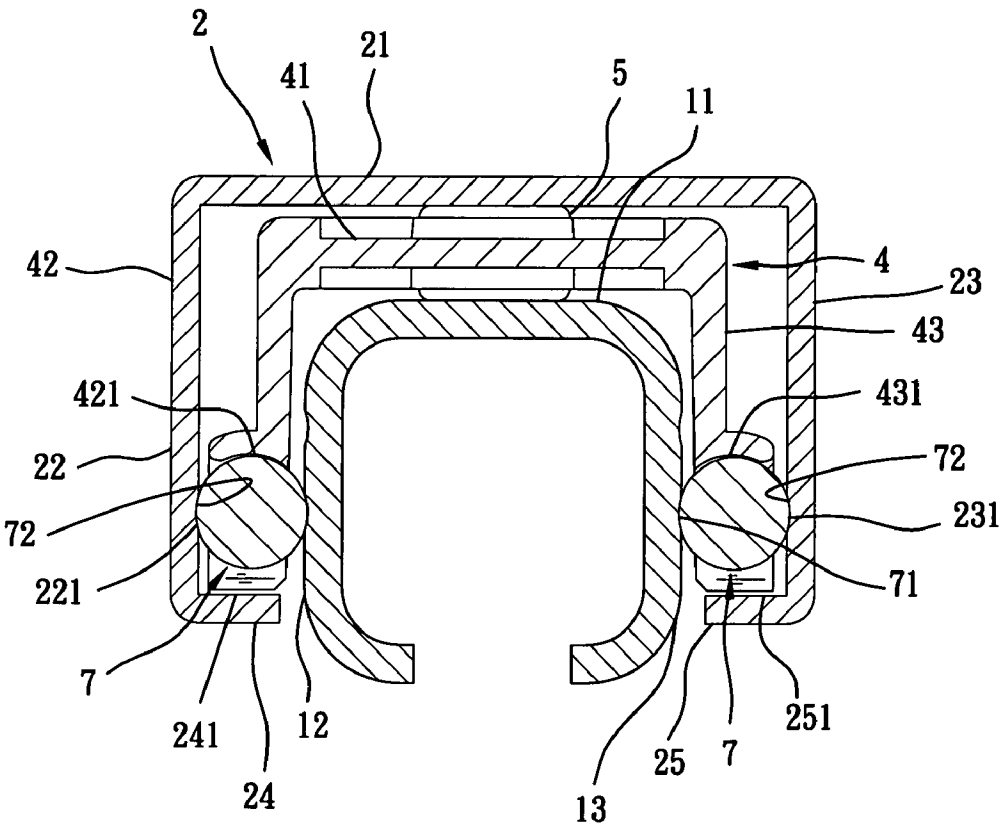
FIG. 9 is another cross-sectional view of the sliding rail coupling structure according to the present invention.
Figure 10:
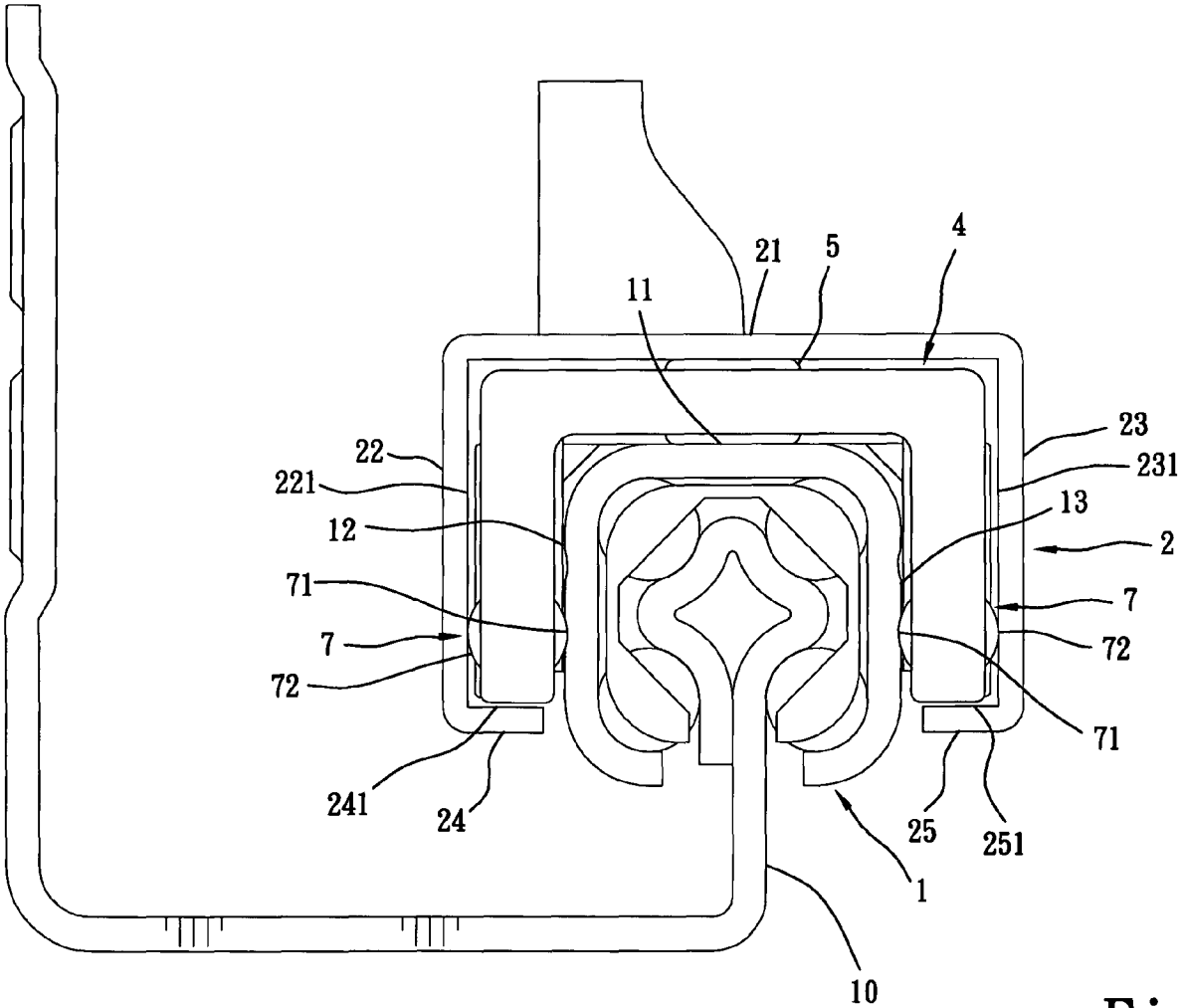
FIG. 10 is a sectional view in an enlarged scale, showing the sliding rail coupling structure used in a hidden sliding track assembly according to the present invention.

Referring to FIGS. 5~10, a hidden sliding track assembly is shown comprised of an inner sliding rail 10 (see FIG. 10), an intermediate sliding rail 1, and an outer sliding rail 2.

The intermediate sliding rail 1 has a narrow elongated top wall 11, two sidewalls 12 and 13 respectively downwardly extended from the two opposite lateral sides of the narrow elongated top wall 11 along the length, and a plurality of stop blocks 111, 112 and 113 protruded from the top side of the narrow elongated top wall 11.

The outer sliding rail 2 has a narrow elongated top wall 21, two sidewalls 22 and 23 respectively downwardly extended from the two opposite lateral sides of the narrow elongated top wall 21 along the length, and two bottom flanges 24 and 25 respectively perpendicularly extended from the sidewalls 22 and 23 along the length of the sidewalls 22 and 23 toward each other.

Sliding bearing bushes 3 and 4 are slidably provided between the intermediate sliding rail 1 and the outer sliding rail 2. Each sliding bearing bush 3 or 4 has a top wall 31 or 41, a left sidewall 32 or 42 and a right sidewall 33 or 43 respectively downwardly extending from the two opposite lateral sides of the top wall 31 or 41 (see FIGS. 8 and 9), a plurality of transverse coupling holes 311 or 411 located at the top side of the top wall 31 or 41, and a plurality of rolling cylinders 5 respectively rotatably mounted in the transverse coupling holes 311 or 411 in such a manner that each rolling cylinder 5 has the respective bottom side 51 disposed in contact with the narrow elongated top wall 11 of the intermediate sliding rail 11 (see FIGS. 8 and 9) and the respective top side 52 disposed in contact with the inner surface 211 of the narrow elongated top wall 21 of the outer sliding rail 2, and a plurality of coupling holes 321 and 331, or 421 and 431 respectively located at the left and right sidewalls 32 and 33, or 42 and 43. Further, the front and rear sides of the top wall 31 or 41 of each sliding bearing bush 3 or 4 will be alternatively stopped by two of the stop blocks 111, 112 and 113 of the intermediate sliding rail 1 during movement.

Two support rollers 6 are respectively provided at the left and right sides of the intermediate sliding rail 1. The support rollers 6 have the respective bottom side 61 respectively disposed in contact with the inner surfaces 241 and 251 of the two bottom flanges 24 and 25 of the outer sliding rail 2. When the intermediate sliding rail 1 and the outer sliding rail 2 are coupled together and moved relative to each other, the support rollers 6 support the intermediate sliding rail 1 in the outer sliding rail 2 and facilitate sliding movement of the intermediate sliding rail 1 relative to the outer sliding rail 2.

The main features of the present invention are outlined hereinafter.

The intermediate sliding rail 1 has two longitudinal sliding grooves 121 and 131 respectively formed on the two sidewalls 12 and 13 on the outside The coupling holes 321 and 331; 421 and 431 of the left and right sidewalls 32 and 33; 42 and 43 of the sliding bearing bushes 3 and 4 are rolling ball socket holes respectively mounted with a respective rolling ball 7. The rolling balls 7 have the respective inner side 71 respectively slidably received in the longitudinal sliding grooves 121 and 131 of the intermediate sliding rail 1 and the respective outer side 72 respectively slidably disposed in contact with the inner surfaces 221 and 231 of the sidewalls 22 and 23 of the outer sliding rail 2 (see FIGS. 8 and 9).

The support rollers 6 are respectively pivotally mounted on a roller holder 8. The roller holder 8 has a top wall 81 affixed to the narrow elongated top wall 11 of the intermediate sliding rail 1, left and right sidewalls 82 and 83 respectively downwardly extending from two opposite lateral sides of the top wall 81, and two pivot axles 821 and 831 respectively perpendicularly protruded from the left and right sidewalls 82 and 83. The support rollers 6 are respectively pivotally mounted on the pivot axles 821 and 831. Further, the top wall 81 has a mounting through hole 811 fastened to the narrow elongated top wall 11 of the intermediate sliding rail 1 with a rivet 812. Alternatively, the top wall 81 can be bonded to the narrow elongated top wall 11 of the intermediate sliding rail 1 by a welding technique.

Further, the intermediate sliding rail 1 has two longitudinal reinforcing grooves 122 and 132 respectively formed on the two sidewalls 12 and 13 to reinforce the structural strength.

Further, the roller holder 8 can be made of a metal material by means of a stamping technique, facilitating the fabrication of the roller holder and the mounting of the support rollers 6 and saving much the device cost.

As stated above, the invention has the following features and advantages:

1. The intermediate sliding rail 1 has longitudinal sliding grooves 121 and 131 respectively formed on the two sidewalls 12 and 13 on the outside to support the inner side 71 of each of the rolling balls 7 and to guide movement of the rolling balls 7.

2. The intermediate sliding rail 1 has longitudinal reinforcing grooves 122 and 132 respectively formed on the two sidewalls 12 and 13 to reinforce the structural strength.

3. The roller holder 8 can easily and quickly be fastened to the intermediate sliding rail 1 to support the support rollers 6, enabling the support rollers 6 to support the intermediate sliding rail 1 in the outer sliding rail 2 and facilitate sliding movement of the intermediate sliding rail 1 relative to the outer sliding rail 2. Further, the roller holder 8 can be made of a metal material by means of a stamping technique, facilitating the fabrication and mounting of the support rollers 6 and saving much the device cost.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A sliding rail coupling structure comprising:

an intermediate sliding rail, said intermediate sliding rail comprising a narrow elongated top wall, two sidewalls respectively downwardly extended from two opposite lateral sides of the narrow elongated top wall of said intermediate sliding rail along the length of said intermediate sliding rail, and a plurality of stop blocks protruded from a top side of the narrow elongated top wall of said intermediate sliding rail;

an outer sliding rail, said outer sliding rail comprising a narrow elongated top wall, two sidewalls respectively downwardly extended from two opposite lateral sides of the narrow elongated top wall of said outer sliding rail along the length of said outer sliding rail, and two bottom flanges respectively perpendicularly extended from the sidewalls of said outer sliding rail along the length of the sidewalls of said outer sliding rail toward each other;

a plurality of sliding bearing bushes slidably provided between said intermediate sliding rail and said outer sliding rail, each said sliding bearing bush comprising a top wall, a left sidewall and a right sidewall respectively downwardly extending from two opposite lateral sides of the top wall of the respective sliding bearing bush, a plurality of transverse coupling holes located at a top side of the top wall of the respective sliding bearing bush, and a plurality of rolling cylinders respectively rotatably mounted in said transverse coupling holes and supported between the narrow elongated top wall of said intermediate sliding rail and the narrow elongated top wall of said outer sliding rail, and a plurality of coupling holes respectively located at the left and right sidewalls of the respective sliding bearing bush;

two support rollers respectively provided at left and right sides of said intermediate sliding rail and disposed in contact with the two bottom flanges of said outer sliding rail;

wherein:

said intermediate sliding rail has two longitudinal sliding grooves respectively formed on the two sidewalls thereof and extending along the length of the two sidewalls thereof and respectively facing the sidewalls of said outer sliding rail;

the coupling holes of the left and right sidewalls of said sliding bearing bushes are rolling ball socket holes respectively mounted with a respective rolling ball, the rolling balls in the coupling holes of said sliding bearing bushes being respectively kept in contact between the longitudinal sliding grooves of said intermediate sliding rail and the sidewalls of said outer sliding rail;

said support rollers are respectively pivotally mounted in a roller holder at two sides, said roller holder being affixed to said intermediate sliding rail.

2. The sliding rail coupling structure as claimed in claim 1, wherein said roller holder comprises a top wall fixedly connected to the narrow elongated top wall of said intermediate sliding rail, two sidewalls respectively downwardly extending from two opposite lateral sides of the top wall of said roller holder and respectively adjacent to the two sidewalls of said intermediate sliding rail, and two pivot axles respectively perpendicularly protruded from the two sidewalls of said roller holder and adapted for supporting said support rollers.

3. The sliding rail coupling structure as claimed in claim 2, wherein the top wall of said roller holder has a mounting through hole fixedly fastened to the narrow elongated top wall of said intermediate sliding rail with a fastening member.

* * * * *